US009004939B2

(12) United States Patent
Okano et al.

(10) Patent No.: US 9,004,939 B2
(45) Date of Patent: Apr. 14, 2015

(54) CONNECTOR

(71) Applicant: Sumitomo Wiring Systems, Ltd., Yokkaichi, Mie (JP)

(72) Inventors: Tomoki Okano, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/908,487

(22) Filed: Jun. 3, 2013

(65) Prior Publication Data

US 2013/0337690 A1 Dec. 19, 2013

(30) Foreign Application Priority Data

Jun. 13, 2012 (JP) ..... 2012-133735

(51) Int. Cl.
*H01R 13/40* (2006.01)
*H01R 13/58* (2006.01)
*H01R 13/46* (2006.01)

(52) U.S. Cl.
CPC ..... *H01R 13/58* (2013.01); *H01R 13/46* (2013.01); *Y10S 439/901* (2013.01)

(58) Field of Classification Search
USPC ..... 439/521, 587, 589, 625, 660, 901
See application file for complete search history.

(56) References Cited

U.S. PATENT DOCUMENTS 6,997,759 B1 * 2/2006 Zahnen et al. ..... 439/798
7,217,157 B2 * 5/2007 Onoda et al. ..... 439/589
8,628,359 B2 * 1/2014 Yokoyama et al. ..... 439/675

FOREIGN PATENT DOCUMENTS

JP 2010-073357 4/2010

* cited by examiner

*Primary Examiner* — Khiem Nguyen
(74) *Attorney, Agent, or Firm* — Gerald E. Hespos; Michael J. Porco; Matthew T. Hespos

(57) ABSTRACT

A connector has a tube (11) formed such that a first half tube (16) and a second half tube (21) are connected via maximum width portions (14). The first half tube (16) is formed with a high rigidity portion (17) that has a higher rigidity than the second half tube (21) and is arranged substantially in a central part of the first half tube (16) in a width direction. The first half tube (16) is formed with first thin portions (22) by being partly thinned in areas deviated from the high rigidity portion (17). The second half tube (21) is formed with second thin portions (23) by being partly thinned and the second thin portions (23) have an axial dimension shorter than that of the first thin portions (22).

10 Claims, 8 Drawing Sheets

CONNECTOR

BACKGROUND

1. Field of the Invention

The invention relates to a connector.

2. Description of the Related Art

Japanese Unexamined Patent Publication No. 2010-073357 discloses a connector designed to reduce weight while maintaining the strength. The connector has a tube that with a plurality of thick portions and a plurality of thin portions. The thick portions are highly rigid and make the tube difficult to deform even if subjected to an external force in a direction to squeeze the tube. Further, the thin portions enable the weight of the connector to be reduced.

The thin portions are arranged uniformly over the entire area of the tube and a high rigidity portion is formed on a part of the tube in a circumferential direction. As a result, stress may concentrate on a part when the tube is subjected to an external force in a direction to squeeze the tube.

The invention was completed in view of the above situation and an object thereof is to avoid stress concentration on a tube in a connector in which the tubular portion is formed with thin portions for weight reduction.

SUMMARY OF THE INVENTION

The invention relates to a connector with a tube that is continuous over the entire circumference. One or more maximum width portions form part of the tube. The tube includes a first tube part that is connected to the one or more maximum width portions and a second part that is connected to the first tube part via the one or more maximum width portions. At least one high rigidity portion is formed only on the first tube part and has a higher rigidity than the second tube part. The high rigidity portion is arranged in an intermediate area of the first tube part in the width direction. At least one first thin portion is formed by partly thinning the first tube part in an area deviated from the high rigidity portion. At least one second thin portion is formed by partly thinning the second tube part and has an axial dimension shorter than that of the first thin portion.

An external force may act on the tube in a direction to bring the first and second tube parts closer. As a result, the first and second tube parts are deformed resiliently with the maximum width portion as supports. At this time, a flexible range of the second tube part is the entire area from the maximum width portion to the widthwise central part. However, a flexible range of the first tube part formed with the high rigidity portion in the widthwise intermediate part is an area excluding the high rigidity portion in the width direction and narrower than that of the second tube part. Thus, the second tube part is deformed resiliently more easily than the first tube part, considering only the extent of the flexible range. Thus, stress may concentrate on the second tube part.

Accordingly, an axial formation range of the first thin portion formed on the first tube part is made larger than that of the second thin portion formed on the second tube part. An imbalance in flexural rigidity between the first and second tube parts is alleviated in this way, thereby further alleviating stress concentration on the second tube part.

Two lateral maximum width portions preferably are provided as part of the tube and are at a maximum distance from each other in a width direction.

Opposite ends of the first tube part in the width direction preferably are connected to the two maximum width portions.

Opposite ends of the second tube part in the width direction preferably are connected to the first tube part via the maximum width portions.

The high rigidity portion preferably is arranged substantially in a central part of the first tube part in the width direction.

The invention also relates to a connector with a tube that is continuous over the entire circumference. The tube has left and right maximum width portions that are at a maximum distance from each other in a width direction. The tube also has first and second half tube portions. Opposite ends of the first half tube portion in the width direction are connected to the maximum width portions. Opposite ends of the second half tube portion in the width direction are connected to the first half tube portion via the maximum width portions. A high rigidity portion is formed only on the first half tube portion. The high rigidity portion is more rigid than the second half tube portion and is substantially in a central part of the first half tube portion in the width direction. A first thin portion is formed by partly thinning the first half tube portion in an area deviated from the high rigidity portion and a second thin portion is formed by partly thinning the second half tube portion. The second thin portion is axially shorter than the first thin portion.

An external force may act on the tube in a direction to bring the first and second half tube portions closer. Thus, the first and second half tube portions are deformed resiliently with the maximum width portions as supports. A flexible range of the second half tube portion is the entire area from the maximum width portions to the widthwise central part. However, the first half tube portion is formed with the high rigidity portion in the widthwise central part and a flexible range of the first half tube portion excludes the high rigidity portion in the width direction and is narrower than the second half tube portion. Thus, the second half tube portion is deformed more easily than the first half tube portion. Stress may concentrate on the second half tube portion. Accordingly, an axial formation range of the first thin portion on the first half tube portion is larger than the formation range of the second thin portion on the second half tube portion. Thus, an imbalance in flexural rigidity between the first and second thin portions is alleviated, and stress concentration on the second half tube portion also is alleviated.

A rear part of the tube in an axial direction may be supported on the outer periphery of a main body and the front end of the tube in the axial direction may be open. Axial centers of the first and second thin portions may be located behind axial centers of the tube.

A rear end of the tube supported on the main body and is relatively difficult to deform. However, a front end of the tube is open and relatively easy to deform. Thus, the rigidity of the tube is not uniform in the axial direction. Therefore, axial center positions of the first and second thin portions are arranged behind the axial center of the tube. This alleviates nonuniformity in rigidity in the axial direction of the tube.

The first and/or second thin portions may be formed by cutting the outer periphery of the tube and/or open to the back of the tubular portion in the axial direction. More particularly, the first and second thin portions can be formed by molds that are opened in the axial direction to form the tube. Thus, a mold that is opened in a direction intersecting the axial direction is not necessary, thereby simplifying a mold structure.

The connector may further comprise at least one third thin portion formed by partly thinning the maximum width portion. The third thin portion may be connected to the first and second thin portions.

The third thin portion further reduces the weight. The maximum width portion functions as a support when the first and second half tube portions are resiliently deformed. The third thin portion makes the maximum width portion more easily deformable. Thus, stress is distributed to the maximum width portion and stress concentration is alleviated more effectively.

A formation range of the second thin portion in the axial direction preferably is smaller than a formation range of the first thin portion and/or a formation range of the second thin portion in the circumferential direction preferably is larger than a formation range of the first thin portion.

The maximum width portion preferably comprises at least one groove on the inner side of the tube.

These and other features and advantages of the invention will become more apparent upon reading the following detailed description of preferred embodiments and accompanying drawings. Even though embodiments are described separately, single features thereof may be combined to additional embodiments.

DETAILED DESCRIPTION OF THE PREFERRED EMBODIMENTS

A connector in accordance with invention is made integrally or unitarily e.g. of synthetic resin and has a substantially block-shaped main body 10 and a tube 11 surrounding the main body 10 over substantially the entire circumference. The connector of this embodiment is a female connector in which one or more female terminal fittings (not shown) are accommodated in the main body 10. A substantially flange-like support 12 is formed on the outer periphery of the main body 10, and a rear part of the tube 11 is connected to the support 12. Thus, the tube 11 is cantilevered forward. A forwardly open tubular connection space 13 is formed between the outer periphery of the main body 10 and the inner periphery of the tube 11. A receptacle of a male connector (not shown) can be fit into the connection space 13. The receptacle surrounds tabs of male terminal fittings (not shown) mounted in the male connector.

Figure 1:
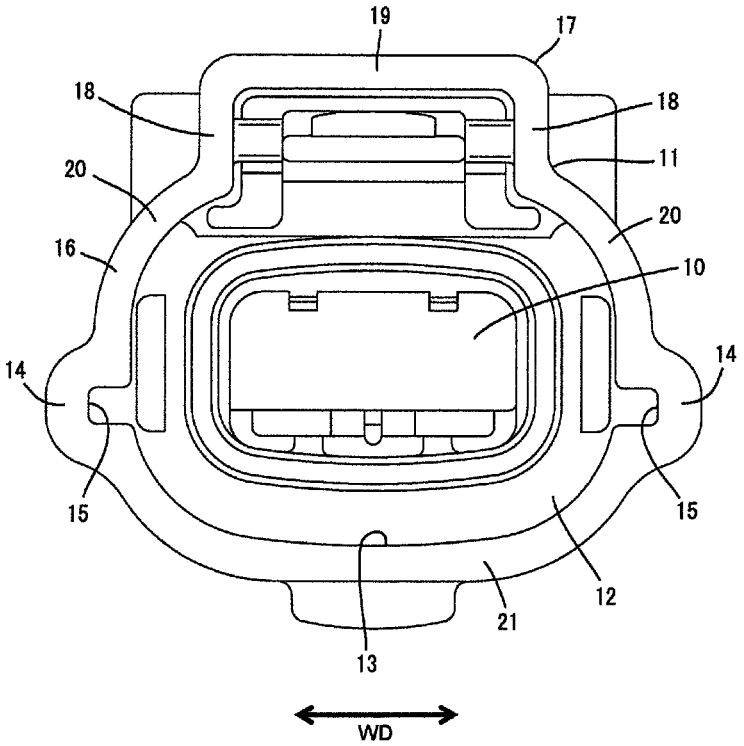
FIG. 1 is a front view of a connector of one embodiment.

As shown in FIG. 1, the tube 11 is substantially continuous over the entire circumference and has left and right maximum width portions 14 and first and second half tubes 16 and 21. The left and right maximum width portions 14 are parts of the tube 11 that are at a maximum distance from each other in the width direction WD. Note that "lateral direction" and "width direction" are synonyms in the following description. The maximum width portions 14 locally project radially out of the tube 11 and each is formed with a groove 15 by recessing the inner surface of the tube 11. The maximum width portions 14 each are bent to have a substantially V- or U-shaped or convex transverse section, and hence are more difficult to deform and have a higher rigidity than the first and second half tubes 16, 21.

The first half tube 16 is curved to project up and constitutes a first or upper half area of the tube 11. Downward or distal facing opposite ends of the first half tube 16 in the width direction WD are connected to the maximum width portions 14. At least one high rigidity portion 17 is formed in a substantially in a widthwise central part of the first half tube 16. The high rigidity portion 17 is formed only on the first half tube 16, and is not formed on the second half tube 21. The high rigidity portion 17 comprises two bilaterally symmetrical vertical side walls 18 and an upper wall 19 arranged substantially at a right angle to the side walls 18 and connecting the upper ends of the side walls 18. Areas of the first half tube 16 excluding the high rigidity portion 17 define substantially bilaterally symmetrical arcuate walls 20. The high rigidity portion 17 having a bent shape has a higher rigidity than the smoothly curved arcuate walls 20.

The second half tube 21 is curved to project down and constitutes a substantially lower half area of the tube 11. Upward facing opposite ends of the second half tube 21 in the width direction WD are connected to the maximum width portions 14. Accordingly, the second and first half tubes 21, 16 are connected via the maximum width portions 14. The grooves 15 are formed on boundaries between the opposite end parts of the first half tube 16 and those of the second half tube 21. The second half tube 21 is curved substantially smoothly over the entire area in the width direction WD, and has a lower rigidity than the high rigidity portion 17 with the bent shape.

The tubular portion 11 is thinned in parts to reduce weight and/or stress concentration due to the thinning for weight reduction. A specific configuration is described below. Note that "forward and backward directions" and "axial direction of the tubular portion 11" are used as synonyms in the following description.

As shown in FIGS. 2, 6 to 8, the first half tube 16 has two substantially bilaterally symmetrical first thin portions 22 partly and lightly recessed on its outer periphery. A formation range of the first thin portions 22 in the circumferential direction (width direction WD) is an area of the first half tube 16 excluding the high rigidity portion 17. The formation range of the first thin portions 22 in the circumferential direction is less than about ⅔ of the arcuate portions 20 (preferably only substantially half areas of the arcuate portions 20) near the maximum width portions 14.

Figure 2:
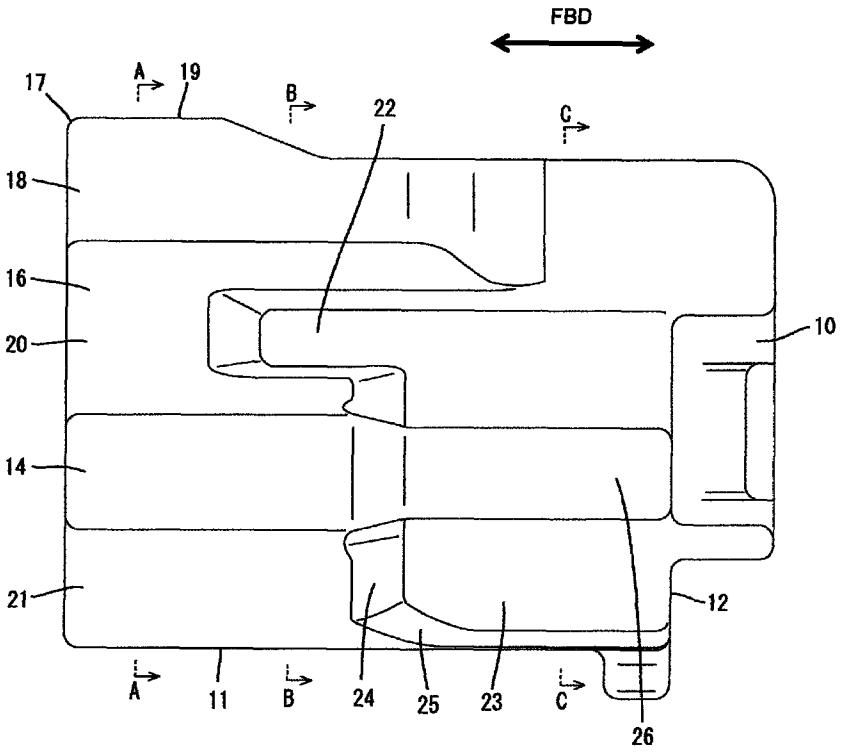
FIG. 2 is a side view of the connector.
Figure 3:
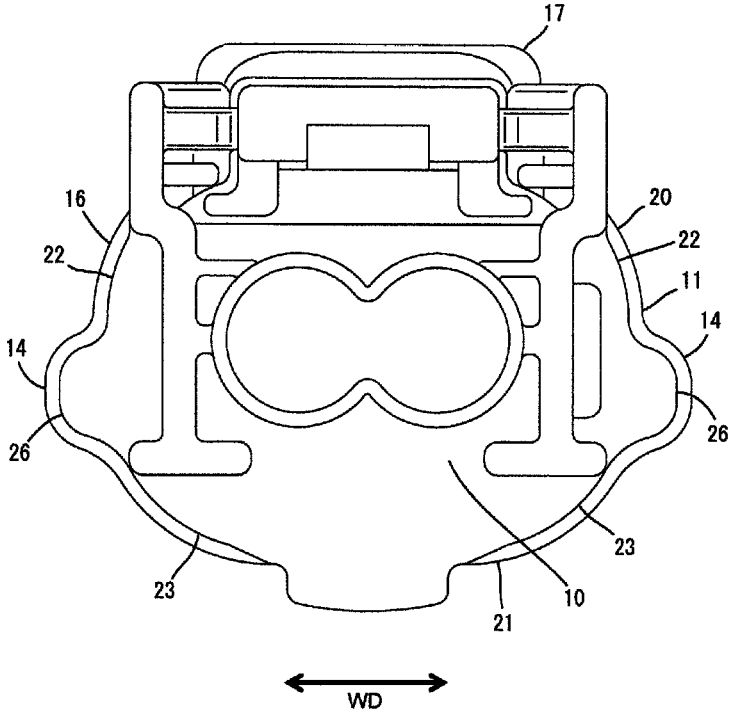
FIG. 3 is a rear view of the connector.
Figure 4:
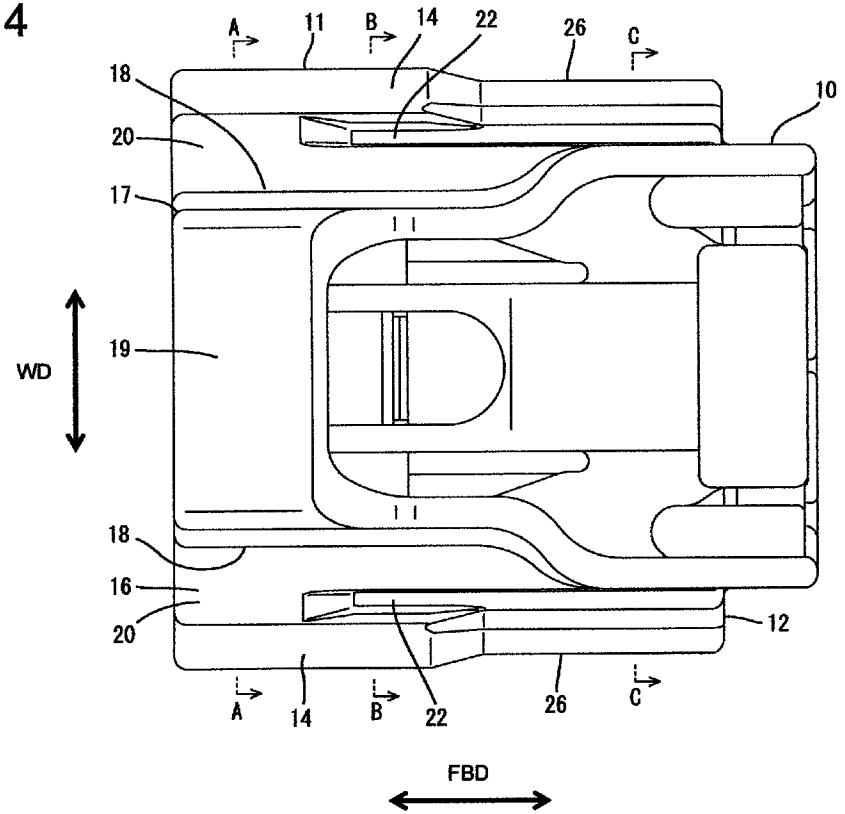
FIG. 4 is a plan view of the connector.

As shown in FIG. 2, the first thin portions 22 are continuous in forward and backward directions FBD. A formation range of the first thin portions 22 in forward and backward directions FBD is an area from a position slightly behind the front end of the tube 11 (arcuate portions 20) to the rear end of the tube 11. That is, axial centers of the first thin portions 22 are located behind the axial center of the tubular portion 11. Thus, the front ends of the first thin portions 22 are not open to the front of the tube 11. On the other hand, the rear ends of the first thin portions 22 are open to the back of the tube 11 over substantially the entire area in the circumferential direction.

As shown in FIGS. 2, 6 to 8, the second half tube 21 is formed with two substantially bilaterally symmetrical second thin portions 23 by partly and lightly recessing only its outer periphery. A formation range of the second thin portions 23 in the circumferential or width direction WD preferably is the substantially entire area of the second half tube 21 excluding a central part (part vertically facing the high rigidity portion 17). The formation range of the second thin portions 23 in the circumferential direction is wider or more extensive than that of the first thin portions 22.

The second thin portions 23 are continuous in forward and backward directions FBD. A formation range of the second thin portions 23 in forward and backward directions FBD is an area from a position slightly behind the front ends of the first thin portions 22 to the rear end of the tube 11. That is, the formation range of the second thin portions 23 in the axial or longitudinal direction is less than that of the first thin portions 22. Axial centers of the second thin portions 23 are behind the axial centers of the tube 11 and the first thin portions 22. Thus, the front ends of the second thin portions 23 are not open to the front of the tube 11. On the other hand, the rear ends of the second thin portions 23 are open to the back of the tube 11 over their entire area in the circumferential direction.

Figure 5:
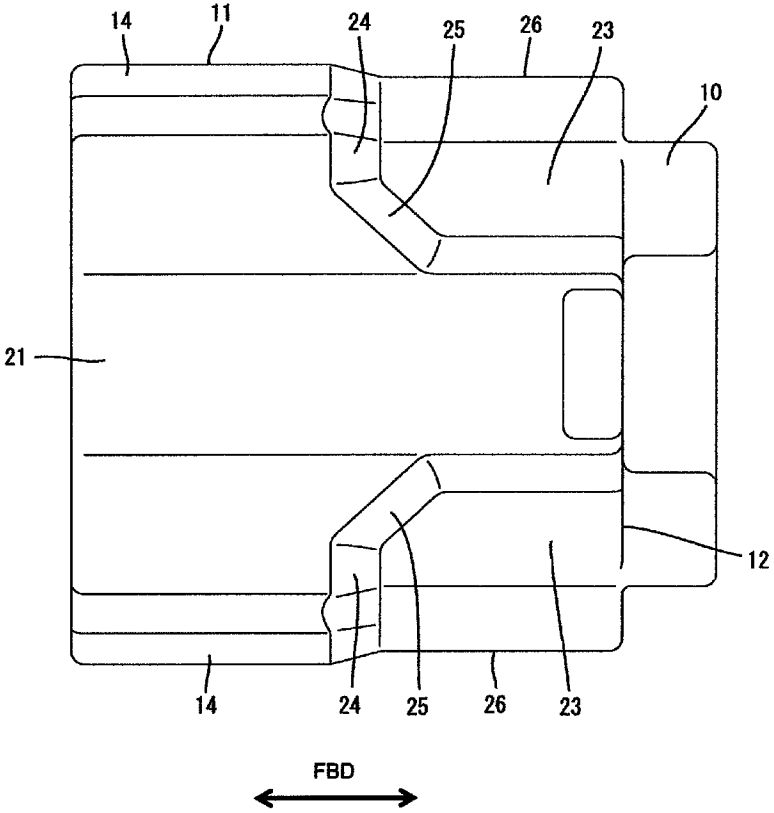
FIG. 5 is a bottom view of the connector.
Figure 6:
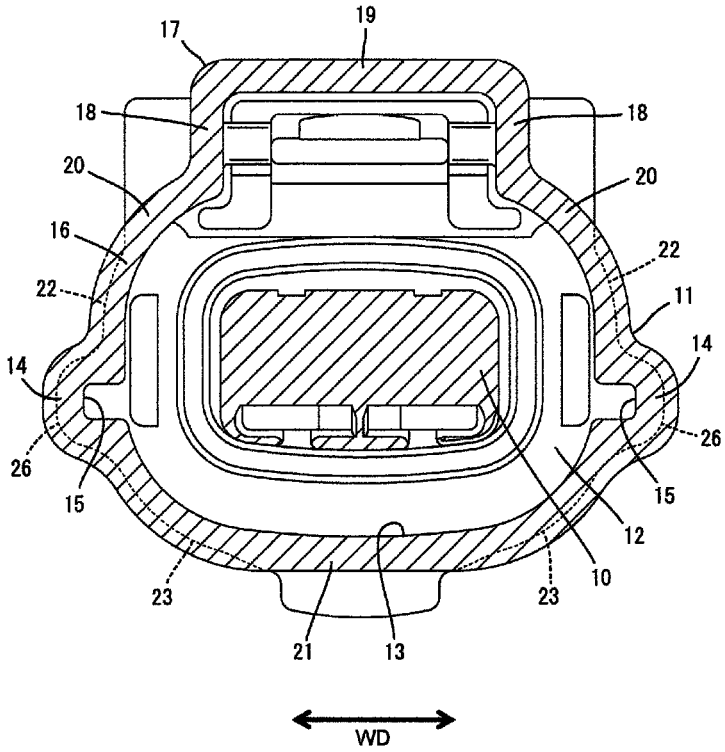
FIG. 6 is a section along A-A of FIGS. 2 and 4.
Figure 7:
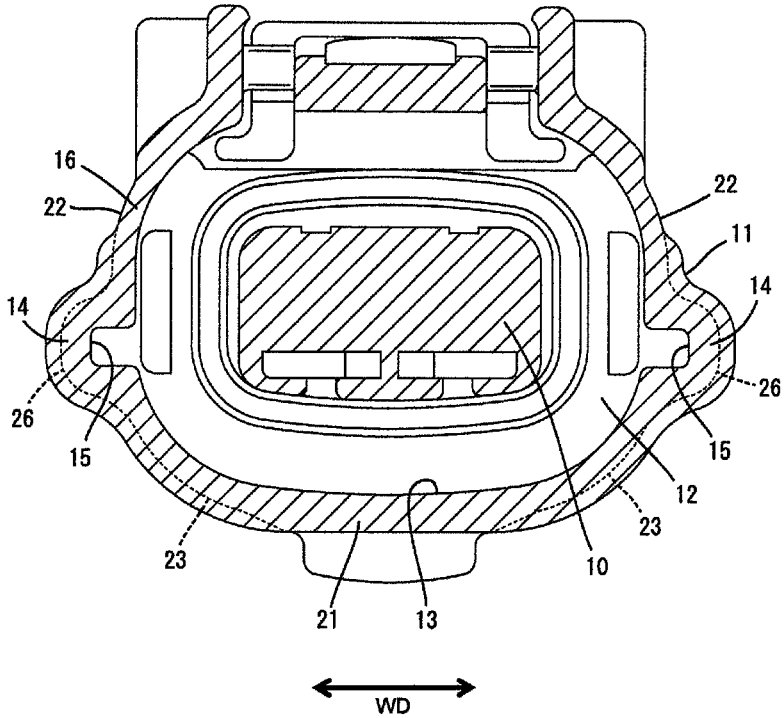
FIG. 7 is a section along B-B of FIGS. 2 and 4.
Figure 8:
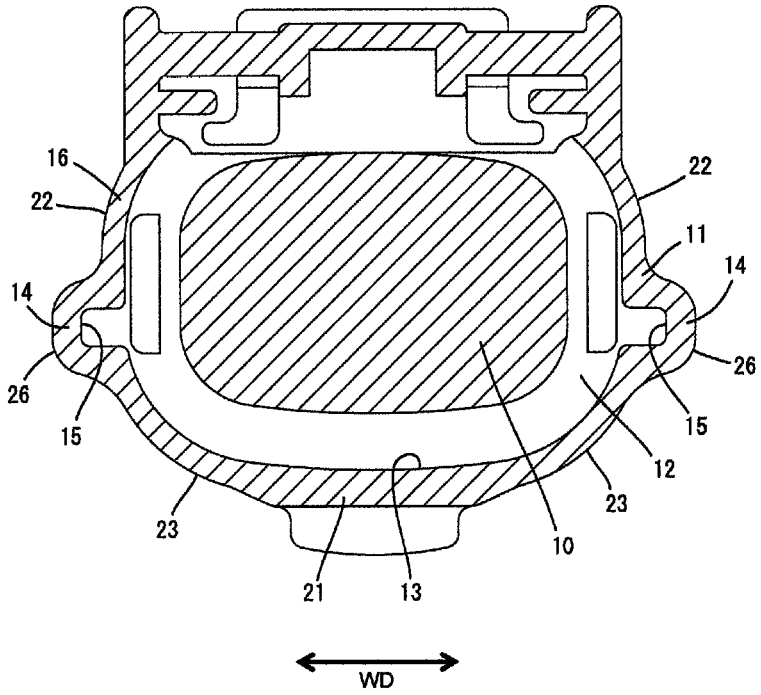
FIG. 8 is a section along C-C of FIGS. 2 and 4.

As shown in FIGS. 2 and 5, an area of the front end edge of the second thin portion 23 near the maximum width portion 14 defines a right-angled edge 24 at a right angle to the axial direction. An axial dimension of the second thin portion 23 is substantially constant in an area corresponding to the right-angled edge 24. Further, an area of the front end edge of the second thin portion 23 at a widthwise central side (area at a lower side) defines an inclined edge 25 that is inclined with respect to the axial direction instead of being at a right angle to the axial direction. The axial dimension of the second thin portion 23 becomes smaller with distance from the maximum width portion 14 in an area corresponding to the inclined edge 25 (area at the lower end not corresponding to the right-angled edge portion 24).

As shown in FIG. 2, the maximum width portions 14 are long and narrow in forward and backward directions FBD. The maximum width portions 14 are formed with two substantially bilaterally symmetrical third thin portions 26 by partly and lightly recessing only their outer peripheries. The upper end edge of the third thin portion 26 is connected to the first thin portion 22 in the circumferential direction over its substantially entire area in forward and backward directions FBD and the lower end edge of the third thin portion 26 is connected to the second thin portion 23 in the circumferential direction over its substantially entire area in forward and backward directions FBD. That is, the first and second thin portions 22, 23 are connected via the third thin portion 26.

The third thin portions 26 extend continuous in forward and backward directions FBD along the same formation range as the second thin portions 23. Axial centers of the third thin portions 26 are behind the axial centers of the tube 11 and the first thin portions 22. Thus, the front ends of the third thin portions 26 are not open to the front of the tube 11. On the other hand, the rear ends of the third thin portions 26 are open to the back of the tube 11 over their entire area in the circumferential direction.

External forces may act on an upper part (high rigidity portion 17) and a lower part of the tube 11 in directions to vertically squeeze the tube 11 (i.e. external forces to bring the first and second half tubes 16, 21 closer). Thus, the first and second half tubes 16, 21 are deformed resiliently in the vertical direction with the maximum width portions 14 as supports. At this time, a flexible range of the second half tube 21 is the entire area from the maximum width portions 14 to the widthwise center.

On the other hand, the first half tube 16 is formed with the high rigidity portion 17 in the widthwise central part and the high rigidity portion 17 is less flexible. Thus, the second half tube 21 is deformed more easily resiliently than the first half tube 16 in the circumferential direction (width direction WD). Thus, stress may concentrate on the second half tube 21.

Accordingly, the axial formation range of the first thin portions 22 of the first half tube 16 is made larger than the second thin portions 23 of the second half tube 21. Thus, a rate of decrease in the flexural rigidity of the first half tube 16 is larger than that of the second half tube 21. In this way, an imbalance in flexural rigidity between the first and second half tubes 16, 21 is alleviated or eliminated. This can alleviate stress concentration on the second half tube 21 when the tube 11 is deformed vertically.

A rear end part of the tube 11 in the axial direction is supported on the outer periphery of the main body 10 and is relatively difficult to deform, whereas the front extending end of the tube 11 in the axial direction is open and relatively easy to deform. The rigidity of the tube 11 is not uniform in the axial direction. Accordingly, the axial centers of the first and second thin portions 22, 23 are located behind the axial center of the tube 11. That is, the first and second half tubes 16, 21 are displaced toward the rear end side of the tube 11 in forward and backward directions FBD to alleviate non-uniformity in rigidity in the axial direction of the tubular portion 11.

Further, the first and/or second thin portions 22, 23 particularly are formed by cutting the outer periphery of the tube 11 and/or open to the back of the tube 11 in the axial direction. According to this configuration, the first and second thin portions 22, 23 can be formed by molds which are opened in the axial direction to form the tube 11. Thus, a mold which is opened in a direction intersecting with the axial direction is not necessary. This can simplify a mold structure.

Further, the tube 1 is formed with the one or more third thin portions 26 connected to the first and/or second thin portions 22, 23 by partly thinning the maximum width portions 14. By forming the maximum width portions 14 with the third thin portions 26, a further weight reduction is achieved. Further, the maximum width portions 14 serve as supporting points when the first and second half tubes 16, 21 are resiliently deformed. By forming the third thin portions 26, the maximum width portions 14 become more easily deformable. Since this causes stress to be distributed to the maximum width portions 14, stress concentration is more effectively alleviated.

The invention is not limited to the above described and illustrated embodiment. For example, the following embodiments also are included in the scope of the invention.

Although the first thin portions and the second thin portions are connected via the third thin portions in the above embodiment, the first and second thin portions may be separated from each other without forming the third thin portions.

Although the first thin portions are formed by cutting only the outer peripheral surface of the first half tube in the above embodiment, they may be formed by cutting both the outer and inner peripheral surfaces of the first half tube or by cutting only the inner peripheral surface of the first half tube.

Although the second thin portions are formed by cutting only the outer peripheral surface of the second half tube in the above embodiment, they may be formed by cutting both the outer and inner peripheral surfaces of the second half tube and/or by cutting only the inner peripheral surface of the second half tube.

Although the first thin portions are open to the back of the tube in the above embodiment, they may not be open to the back of the tube.

Although the first thin portions are not open to the front of the tubular portion in the above embodiment, they may be open to the front of the tubular portion.

The second thin portions are open to the back of the tube in the above embodiment, they may not be open to the back of the tube.

Although the second thin portions are not open to the front of the tubular portion in the above embodiment, they may be open to the front of the tubular portion.

The first thin portions may be divided in the axial direction.

The second thin portions may be divided in the axial direction.

Although the axial centers of the first thin portions are located behind that of the tube in the above embodiment, they may be located before the axial center of the tube or at the same position as the axial center of the tube.

Although the axial centers of the second thin portions are located behind that of the tube in the above embodiment, they may be located before the axial center of the tube or at the same position as the axial center of the tube.

Although the second thin portions are formed in the area of the second half tube portion excluding the widthwise central part in the above embodiment, they may be formed over the entire area in the width direction.

The tube surrounds the main body accommodating the female terminal fittings in the female connector in the above embodiment. However, the invention can be applied when a tube is a receptacle surrounding male terminal fittings.

What is claimed is:

1. A connector, comprising:

a tube that is continuous over the entire circumference;

one or more maximum width portions that form part of the tube;

a first tube part that forms part of the tube and being connected to the one or more maximum width portions;

a second tube part that forms part of the tube and being connected to the first tube part via the one or more maximum width portions;

a high rigidity portion formed only on the first tube part and having a higher rigidity than the second tube part, the high rigidity portion being arranged in an intermediate part of the first tube part in the width direction;

at least one first thin portion formed by partly thinning the first tube part in an area deviated from the high rigidity portion; and at least one second thin portion formed by partly thinning the second tube part and having an axial dimension shorter than that of the first thin portion.

2. The connector of claim 1, wherein the one or more maximum width portions comprise two maximum width portions at a maximum distance from each other in the width direction.

3. The connector of claim 2, wherein opposite ends of the first tube part in the width direction are connected to the two maximum width portions.

4. The connector of claim 3, wherein opposite ends of the second tube part in the width direction are connected to the first tube part via the maximum width portions.

5. The connector of claim 1, wherein the high rigidity portion is arranged substantially in a central part of the first tube part in the width direction.

6. The connector of claim 1, wherein:

a rear axial end of the tube is supported on an outer periphery of a main body;

the front axial end of the tube is open; and axial centers of the first and second thin portions are located behind that of the tube.

7. The connector of claim 6, wherein the first and second thin portions are formed by cutting the outer periphery of the tube and open to the back of the tube in the axial direction.

8. The connector of claim 7, further comprising at least one third thin portion formed by partly thinning the maximum width portion and connected to the first and second thin portions.

9. The connector of claim 1, wherein a formation range of the second thin portion in the axial direction is smaller than that of the first thin portion and a formation range of the second thin portion in the circumferential direction is larger than that of the first thin portion.

10. The connector of claim 1, wherein the maximum width portion comprises at least one groove on an inner side of the tubular portion.

* * * * *